United States Patent [19]

Eguchi

[11] Patent Number: 4,627,371

[45] Date of Patent: Dec. 9, 1986

[54] SEWING MACHINE HAVING A STITCH CONTROL DEVICE

[75] Inventor: Yasukata Eguchi, Tokyo, Japan

[73] Assignee: Janome Sewing Machine Co., Ltd., Tokyo, Japan

[21] Appl. No.: 679,019

[22] Filed: Dec. 6, 1984

[30] Foreign Application Priority Data

Dec. 9, 1983 [JP] Japan ..... 58-231267

[51] Int. Cl.[4] ..... D05B 3/02

[52] U.S. Cl. ..... 112/451; 112/453; 112/317

[58] Field of Search ..... 112/451, 453, 317, 316, 112/154, 262.1, 266.1, 121.13

[56] References Cited

U.S. PATENT DOCUMENTS 4,345,532 8/1982 Eguchi ..... 112/317 X 4,393,795 7/1983 Makabe et al. ..... 112/451 X

*Primary Examiner*—Peter Nerbun

*Attorney, Agent, or Firm*—Michael J. Striker

[57] ABSTRACT

In backward progress of straight stitching, stitches are conformed to either a perfect stitch or a hitch stitch without causing mixture of them, and while a needle is turned at a determined one of a right line or a left one from a basic line just before the needle drops on the basic line of a straight stitching, a condition of the thread to penetration of the needle is regulated before the needle dropping, whereby the stitch forming conditions are made uniform, so that satisfactory stitches are formed without requiring any special processes to the stitch forming mechanism members.

1 Claim, 19 Drawing Figures

SEWING MACHINE HAVING A STITCH CONTROL DEVICE

FIELD OF THE INVENTION

This invention relates to a stitch control device of a sewing machine which forms stitches uniformly by means of a control of needle amplitude and a fabric feed in a simple electronic control mechanism.

BACKGROUND OF THE INVENTION

In a backward progress of a straight stitch, fine differences are caused by chance due to, for example, conditions of a stitching thread. These differences make a perfect stitch which is the same stitch as the ordinary stitch seen in FIG. 1(A), a hitch stitch as in FIG. 1(B) or an undesirable mixed stitch of both as shown in FIG. 1(C).

Formation of these stiches will be explained in reference to FIGS. 2 and 3 of the attached drawings. As shown in FIG. 2 (A), just before a needle 1 gets out above a surface of a needle plate (not shown), a hook 3 of a horizontal bobbin carrier 2 catches an upper thread 4, which rotates counterclockwise as indicated by the arrow. At this time, a stitch forming side 4*a* of the upper thread 4 passes along the left side of the needle 1 and penetrates the fabric 5 and passes through a needle eye 6 from its rear side toward the front side. When a thread supply side 4*b* thereof is at the right side of the stitch forming side 4*a*, the upper thread 4 simply crosses with a lower thread 7 through the conditions shown in FIGS. 2(B) and (C) in accompanyment with rotation of the sewing machine, following the arrow marks, and forms a perfect stitch as shown in FIG. 2(D). While the stitch shown in FIG. 1(A) is successively formed from a lower part to an upper part thereof, the needle 1 drops at the right side of the stitch formed at the front side, so that the perfect stitch is produced.

On the other hand, when the stitch forming side 4*a* passes along the right side of the needle 1, the thread supply side 4*b* is at the left side of the stitch forming side 4*a*, and the upper thread 4 crosses with the lower thread through the conditions shown in FIGS. 3(B) and (C) in accompanyment with rotation of the sewing machine, and further it also crosses with itself, and forms a hitch stitch as shown in FIG. 3(D). When the stitch is formed as shown in FIG. 1(B), the needle 1 drops at the left side of the stitch formed at the front side, so that the hitch stitch is produced.

However, in the backward progress of the straight stitch, it is rare that the stitch is united into any one of the perfect stitch or the hitch stitch, but rather as seen in FIG. 1(C), those are very often mixed alternately or irregularly.

With respect to a cause of such mixture, under the condition of FIG. 2(D), after the perfect stitch is formed and when the fabric 5 is moved toward the operator, the lower thread 7 pushes the thread supply side which is about to form a stitch, to the right side at a crossing point 8, and therefore the thread supply side 4*b* gets out at a position toward the right side from the center line, so that the thread supply side 4*b* is directed to be easily at the right side of the needle 1, and a subsequent stitch is very often made a hitch stitch.

Under the condition shown in FIG. 3(D), since the upper thread 4 pushes the thread supply side 4*b* to the left side by crossing with itself, the needle drops at the right side of the thread, and a subsequent stitch is very often made a perfect stitch.

Those stitches are not caused by simple causes, and if they are formed alternately or irregularly, the finished stitches do not look appealing. As countermeasures therefor, special processes have been considered to the bobbin carrier, the needle plate or the fabric presser, but unfortunately satisfactory results have not yet been obtained.

SUMMARY OF THE INVENTION

It is an object of, the present invention to provide a device where the stitch is united to either the perfect stitch or the hitch stitch without causing their mixture, and while the needle is moved to a determined one of the right or left positions from the basic line just before the needle drops on the basic line of the straight stitching, a condition of the thread to penetration of the needle is regulated before the needle drops, whereby the stitch forming conditions are made uniform, so that satisfactory stitches are formed without providing any special process to the stitch forming members.

DETAILED DESCRIPTION OF THE PREFERRED EMBODIMENT

The present invention will be explained in reference to an embodiment of a control circuit shown in the attached drawings.

Figure 1A:
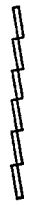
FIGS. 1(A) and 1(B) are views of desirable straight stitch patterns.
Figure 1B:
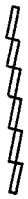
Figure 1C:
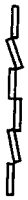
FIG. 1(C) shows an undesirable rough stitch pattern.
Figure 2A:
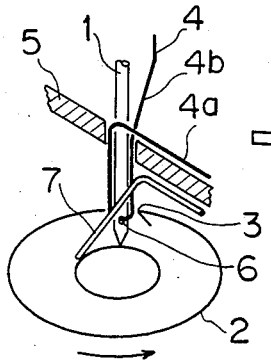
FIGS. 2(A) to (D) show explanatory views of processes for forming a perfect stitch.
Figure 2B:
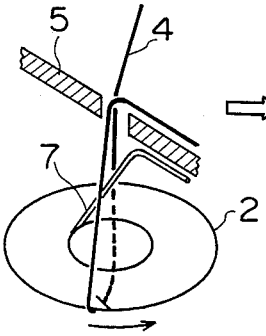
Figure 2C:
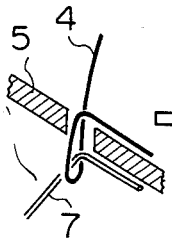
Figure 2D:
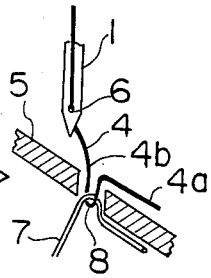
Figure 3A:
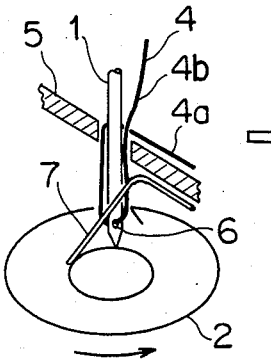
FIGS. 3(A) to (D) show explanatory views of processes for forming a hitch stitch.
Figure 3B:
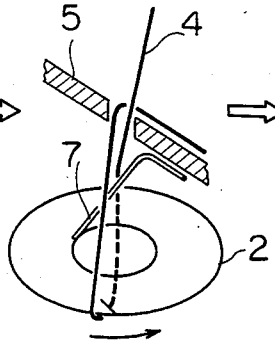
Figure 3C:
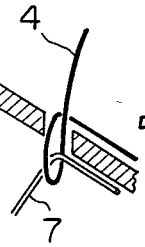
Figure 3D:
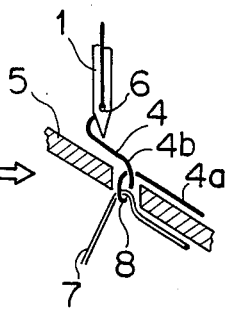
Figure 4:
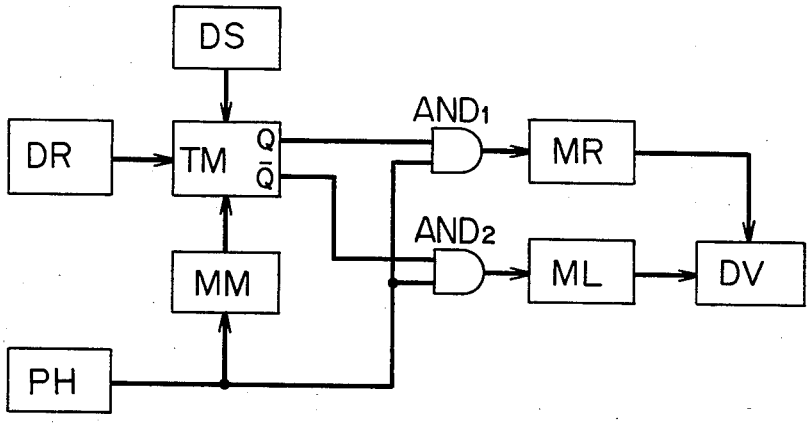
FIG. 4 is a block diagram of an embodiment of the invention.

FIG. 4 is a block diagram showing an amplitude phase detecting device (PH) for detecting rotation phase of an upper shaft of the sewing machine, and when a needle draws loci as seen in FIGS. 5(A) and (A') with its end point, the needle is at a determined position above a surface of the needle plate, and it issues rectangle wave signals as in FIGS. 5(B) and (B') in an interval until it goes down to a determined height (in FIGS. 5(A), (B), (C) . . . those without prime "'" show rotation at low speed of the sewing machine, and those with prime show rotation at high speed thereof).

A pulse motor (MM) issues pulse signals as in FIGS. 5(C) and (C') at the rotation phase of the upper shaft of the sewing machine in the beginning of said interval, that is, at rising of the amplitude phase detecting device (PH). A rotation speed detecting device (DR) is for detecting rotation speed of the upper shaft of the sewing machine. A timer (TM) is operative when a stitching type detecting device (DS) detects that a backward progress of a straight stitch is designated, and the timer starts output at rising of the pulse generator (MM) as seen in FIGS. 5(D) and (D'), and renders an output from its time side H level in such relation that the continuing time of this H level is in reverse proportion to the speed which is detected by the rotation speed detecting device (DR). A stitch memory (ML), in this case, designates a memory exclusively for the straight stitch in response to selection of straight stitching, and stores the stitch control signal in order to set the needle amplitude position at the left basic line (L). A needle amplitude signal memory (MR) stores the needle amplitude signal in order to set the needle amplitude position at the right basic line (R). If required, the needle amplitude signal memory (MR) may be caused to store a plurality of needle amplitude signals to set the amplitude amounts thereof in response to the signal of the rotation speed detecting device (DR).

As shown in FIGS. 5(E) and (E'), when the amplitude phase detecting device (PH) and the output from the true side (Q) of the timer (TM) are both H level, the needle amplitude signal memory (MR) is designated for output via AND circuit (AND1) and gives an amplitude signal to the needle amplitude driving device (DV) in order to set the needle to the right basic line (R). When the amplitude phase detecting device (PH) and the output from a complement side ($\overline{Q}$) of the timer (TM) are both H level, the stitch memory (ML) is designated for output via AND circuit (AND2) and gives the stitch control signal in order to set the needle to the left basic line (L).

Figure 5:
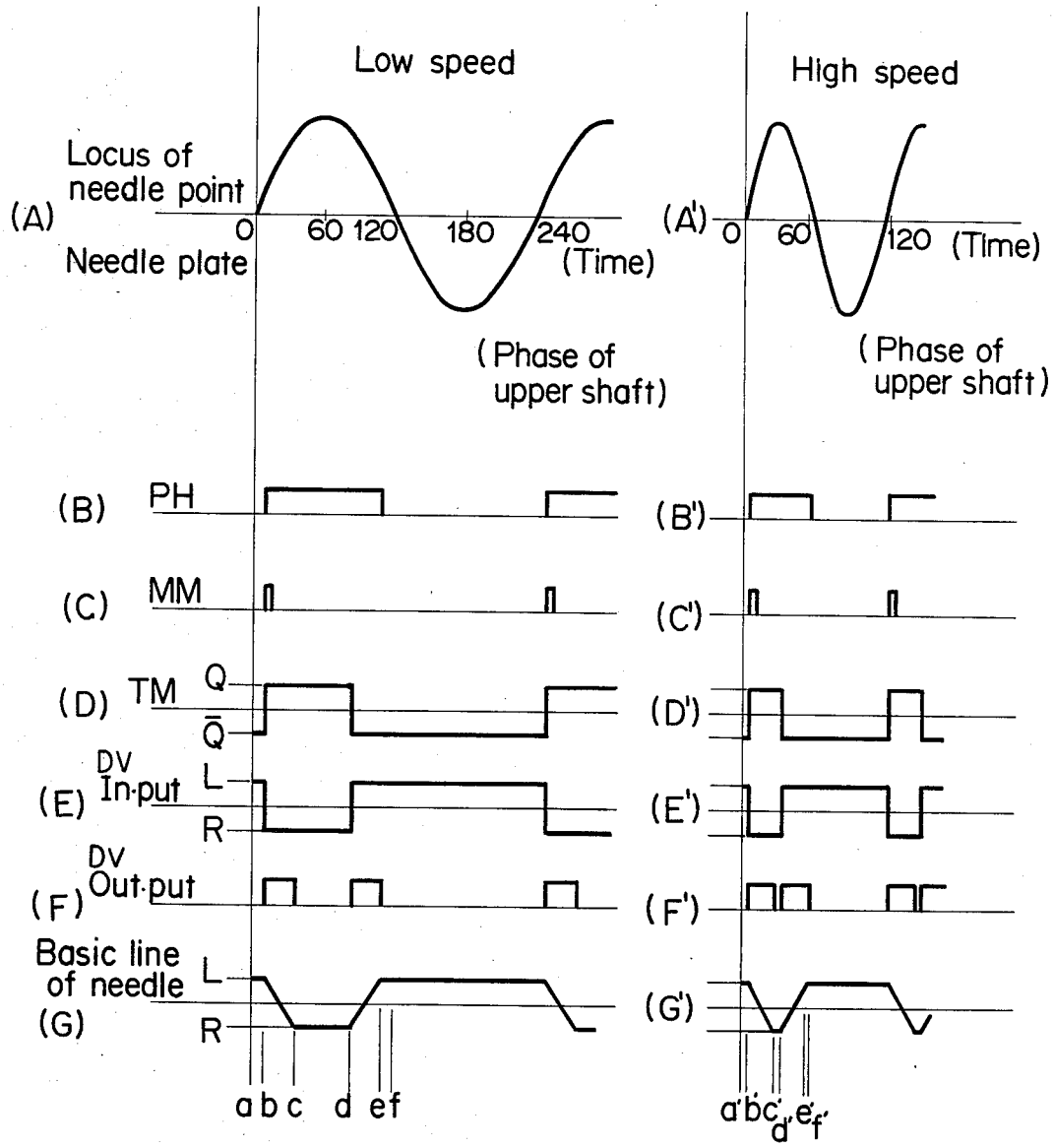
FIG. 5 is a timing chart showing actuation of the above.

A needle drive device (DV) controls lateral driving or swinging of the needle relative to the fabric feeding direction for a necessary period of time each time the signal of the right basic line (R) and the signal of the left basic line (L) are newly issued as in FIGS. 5(F) and (F'). The needle amplitude drive device (DV) is driven in the beginning by the signal of the right basic line (R) when the amplitude phase detecting device (PH) is H level, and is driven by the signal of the left basic line (L) nearly at termination thereof, and as seen in FIGS. 5(G) and (G') the needle is returned from the left basic (L) to the right basic line (R) in the interval between "b" and "e" or "b'" and "e'". This interval is controllable in the amplitude where the needle point is above the fabric, and in addition a time interval between "c'" and "d'" is provided as seen in FIG. 5(G') where the needle is stopped in spite of the high speed. In the instant case, the signal of the basic line of the needle is switched with the timer (TM) but it is allowed that the amplitude phase detecting device (PH) detects the rotation phase of the upper shaft of the sewing machine and the time "d" and "d'" is provided as in FIGS. 5(G) and (G') by means of the phase of the upper shaft.

Figure 6A:
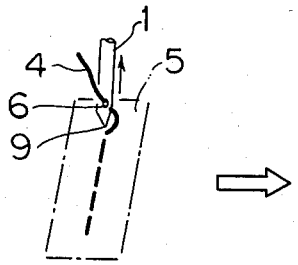
FIGS. 6(A) to (F) are explanatory views of forming stitches according to this invention.
Figure 6B:
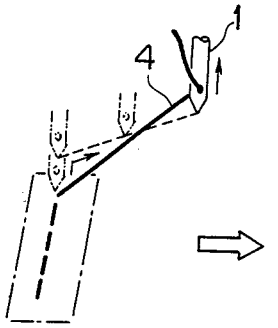
Figure 6C:
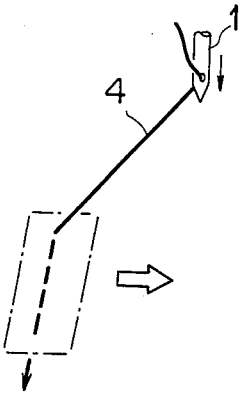
Figure 6D:
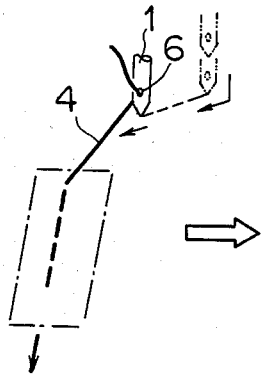
Figure 6E:
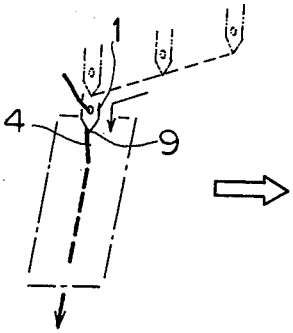
Figure 6F:
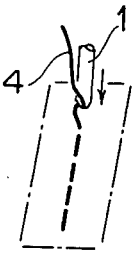

The present device is composed as stated above and an operation thereof will now be explained, referring to FIG. 6. The end point 9 of the needle 1 is above the surface of the needle plate (not shown). Each of the conditions of the phases "a", "a'" to "f", "f'" of FIG. 5(G) corresponds to each of the conditions of FIGS. 6(A) to (F). In order to obtain desirable smooth stitches it is required to constantly drop the needle at a predetermined side of the upper thread. This requirement is met by swinging the needle laterally of the fabric feeding direction when the needle point 9 is located above the fabric. The lateral movements of the needle 1 are indicated by arrows in FIGS. 6(A) to (F). When the needle 1 returns from the right basic line (R) to the left basic line (L) under the condition of FIG. 6(D), an upper thread 4 is at the left side of the needle 1, since the upper thread 4 is pulled from a rear side of this figure to the side of a fabric 5. Also at the left basic line (L) of FIG. 6(E), said left side position is secured. That is, if the upper thread 4 tends to move to the right side by any causes, the end point 9 of the needle 1 prevents such movements. Thus, when the needle 1 penetrates the fabric 5 as seen in FIG. 6(F), the perfect stitch is formed, irrespectively of conditions stitched prior to this perfect stitch. If the signal of the basic line of the stitch memory (ML) and that of the needle amplitude signal memory (MR) are exchanged, a hitch stitch is formed similarly. The signal of the basic line of the stitch memory (ML) is not limited to the left basic line or the right basic line in the needle amplitude range.

According to the present invention, uniform stitches may be produced by means of simple electronic control without requiring special processes on the mechanism members.

What is claimed is:

1. A sewing machine for producing stitch patterns in forward and backward fabric feeding directions, the sewing machine comprising an upper drive shaft rotated to vertically reciprocate a needle, the upper drive shaft having a rotation phase in which the needle is moved above a fabric to be sewn; first memory means ML storing stitch control signals including a straight stitch control signal; drive means DV for swinging the needle laterally of the fabric feeding direction, the drive means being responsive to the straight stitch control signal to shift the needle to a predetermined basic needle position; and a stitch control device including second memory means MR storing a swing control signal for swinging the needle laterally of the fabric feeding direction: detecting means PH for detecting the rotation phase of the upper drive shaft to produce a phase detecting signal which is effective during a predetermined time period corresponding to the rotation phase of the upper shaft; and switching means TM rendered operative in response to information indicating an operation of the sewing machine forming the straight stitches while the fabric is transported in the backward fabric feeding direction, the switching means being responsive to the phase detecting signal to produce a first signal, said first signal making effective the swing control signal of the second memory means to operate the drive means to swing the needle laterally of the fabric feeding direction from the predetermined basic needle position, the switching means subsequently producing a second signal during the predetermined time period, the second signal making effective the straight stitch control signal of the first memory means ML to operate the drive means to thereby return the needle to the predetermined basic needle position.

* * * * *